US006718002B2

(12) United States Patent
Rosengren et al.

(10) Patent No.: US 6,718,002 B2
(45) Date of Patent: Apr. 6, 2004

(54) METHOD AND DEVICE FOR REMOVING RADIOACTIVE DEPOSITS

(75) Inventors: Anders Rosengren, Västerås (SE); Roland Ivars, Ransta (SE); Lennart von der Burg, Västerås (SE)

(73) Assignee: Westinghouse Atom AB, Vasteras (SE)

( * ) Notice: Subject to any disclaimer, the term of this patent is extended or adjusted under 35 U.S.C. 154(b) by 0 days.

(21) Appl. No.: 10/188,109

(22) Filed: Jul. 3, 2002

(65) Prior Publication Data

US 2002/0196892 A1 Dec. 26, 2002

Related U.S. Application Data

(63) Continuation of application No. 09/424,062, filed as application No. PCT/SE98/00973 on May 20, 1998, now abandoned.

(30) Foreign Application Priority Data

May 21, 1997 (SE) ..... 9701896

(51) Int. Cl.[7] ..... G21C 19/00

(52) U.S. Cl. ..... 376/316; 376/260; 134/1

(58) Field of Search ..... 376/310, 313, 376/316; 134/1, 33, 35–37

(56) References Cited

U.S. PATENT DOCUMENTS

| | | | | | |
|---|---|---|---|---|---|
| 4,287,002 | A | * | 9/1981 | Torok | 134/3 |
| 4,461,650 | A | * | 7/1984 | Ozawa | 376/310 |
| 4,655,847 | A | * | 4/1987 | Ichinoseki et al. | 134/7 |
| 4,724,853 | A | * | 2/1988 | Hirose | 134/1 |
| 4,773,357 | A | * | 9/1988 | Scharton et al. | 376/316 |
| 4,800,063 | A | * | 1/1989 | Mierswa et al. | 376/316 |
| 4,806,277 | A | * | 2/1989 | Sakurai et al. | 376/310 |
| 4,828,760 | A | * | 5/1989 | Chung et al. | 376/310 |
| 4,847,042 | A | * | 7/1989 | Musiol et al. | 376/316 |
| 4,972,805 | A | * | 11/1990 | Weems | 376/316 |
| 5,019,329 | A | * | 5/1991 | Franklin et al. | 376/316 |
| 5,092,280 | A | * | 3/1992 | Franklin et al. | 376/316 |
| 5,092,355 | A | * | 3/1992 | Cadwell et al. | 134/1 |
| 5,222,332 | A | * | 6/1993 | Mains, Jr. | 51/320 |
| 5,274,682 | A | * | 12/1993 | McDaniels, Jr. | 376/313 |
| 5,367,838 | A | * | 11/1994 | Visaisouk et al. | 451/39 |
| 5,467,791 | A | * | 11/1995 | Kato et al. | 134/166 |
| 5,483,563 | A | * | 1/1996 | Herb | 376/347 |
| 5,785,581 | A | * | 7/1998 | Settles | 451/99 |

FOREIGN PATENT DOCUMENTS

| | | | | |
|---|---|---|---|---|
| DE | 4129362 | * | 5/1992 | 376/316 |
| JP | 52122793 | * | 10/1977 | 376/313 |
| JP | 54073474 | * | 6/1979 | 376/316 |
| JP | 9065298 | * | 4/1984 | 376/310 |
| JP | 0088699 | * | 5/1984 | 376/310 |
| JP | 01189600 | * | 7/1989 | 376/316 |

* cited by examiner

*Primary Examiner*—Harvey E. Behrend
(74) *Attorney, Agent, or Firm*—Connolly Bove Lodge & Hutz LLP

(57) ABSTRACT

A device and method for removing radioactive crud material deposited on surfaces of a nuclear fuel assembly in a nuclear plant is provided. The device comprises a container arranged to accommodate the nuclear fuel assembly, a first pumping means to pump a fluid, composed of water and ice, through the container in order to release the deposit from the nuclear fuel assembly by abrasion and to transport the released radioactive material out from the container. The first pump means also enables the feeding of a gas or steam or both to the fluid that is fed into and through the container in order to create a turbulence in the fluid. The device further comprises means, arranged in a γ-radiation-dampening medium, disposed to receive the radioactive deposit transported out of the container by the fluid.

19 Claims, 2 Drawing Sheets

METHOD AND DEVICE FOR REMOVING RADIOACTIVE DEPOSITS

REFERENCE TO RELATED APPLICATION

This application is a continuation of U.S. application Ser. No. 09/424,062 which is a 371 application of PCT/SE98100973, filed May 20, 1998, disclosure of which is incorporated herein by reference, which in turn claims priority from Swedish application 9701896-4, filed May 21, 1997.

THE BACKGROUND OF THE INVENTION AND PRIOR ART

The present invention relates to a device for removing a radioactive deposit from a fuel assembly in a nuclear plant which comprises a container, arranged to accommodate the fuel assembly, first means arranged to feed a fluid into and through the container, said fluid being provided to release radioactive deposit from the fuel assembly by means of abrasion and to transport radioactive deposited material out of the container, and second means being arranged to receive the radioactive material transported out of the container by the fluid.

One of the reasons a device such as the present invention is needed in nuclear plants is the deposition of radioactive deposits onto surfaces of the fuel assemblys. Co-60 contributes to a great deal of the radiation burden from these deposits. Furthermore, Co-60 has a half life of 5.3 years, which means that it will not suffice to let the plant stand idle for only a short period in order to permit the radioactive radiation to decay.

The water in reactor water circuits and feed water circuits of the plant cause a precipitation of small amounts of material from the different components with which it is in contact. A great deal of these components are made of stainless steel from which iron, nickel and small amounts of cobalt are precipitated as ions and particles. In older nuclear plants, some components in the reactor and feed water circuit, such as valves, comprise cobalt-rich materials, increasing the amount of precipitated cobalt. The metals precipitated in the reactor water and feed water are deposited onto surfaces in the circuit as oxide, such as so called crud. The crud deposits exist as different types of metal oxides which are subjected to a strong neutron irradiation when, for instance, they are located on cladding tubes for nuclear fuel. Thereby, the metal atoms in crud deposits are transformed into other isotopes, a part of which are radioactive. Particles fall off from and ions are precipitated from the radioactive crud deposition and are thus transferred to the water. Thereby, the particles and the ions are transported with the reactor water to parts located outside the very reactor core and, thereby, distribute the radioactivity to those parts. The radioactive particles and the ions are deposited onto surfaces outside the core as a secondary crud deposit. Accordingly, a crud deposit is also formed outside the core, contributing to the radiation burden of exposed personnel, above all gamma irradiation (γ-irradiation), for instance during maintenance and repair work.

Accordingly, it is desirable to avoid large amounts of crud being present at the fuel assemblies, each of which comprises a plurality of cladding tubes, in the nuclear plant. For instance, this can be done by repeatedly removing from the surfaces of the cladding tubes the crud layers that are formed at the surfaces of the fuel assemblies, that is the cladding tubes, and taking care of those layers. However, with the risk of damaging the surface of the cladding tubes during the removal of such crud layers in view, prior art, as for instance the treating by means of chemicals or mechanical treatment, for example by grinding, is unsuitable. Moreover, it is desirable that the removal of the crud layers can be done relatively quickly, in order to avoid a negative effect upon the efficiency of the plant. It is not necessary to remove all the crud, as a trial of removing firmly bound crud present closest to the surface of the cladding tubes also, most probably, will result in a detrimental effect upon these surfaces. Instead, one should primarily remove loosely bound crud present outside the firmly bound crud layer or layers.

According to the Japanese patent JP 52-12 2793 this problem has been solved by means of a device that comprises a container which is arranged to accommodate a fuel assembly and which is connected to a circuit by means of which a medium comprised by a mixture of liquid and solid particles, for example water and ice, is fed into and through the container. Thereby, the medium will move along the cladding tubes included in the fuel assembly and, thereby, release the loosely bound crud layers present on these cladding tubes by means of abrasion. The medium brings the crud material removed from the fuel assembly with it, and, thereafter, the medium is collected in a filtering device included in the circuit. The solid particles are of such a kind that they melt and form a fluid phase as they pass the hot fuel assembly. Thereby, any extensive need of taking care of such solid particles in the filter device is avoided. In order to obtain an evenly distributed abrasion along the length of the fuel assembly, the circuit system is arranged to interchangeably feed the medium in a first and a second direction respectively to the container. For this purpose, openings are arranged in opposite end walls of the container. However, this device has not found commercial use, probably due to irradiation levels that are too high.

SUMMARY OF THE INVENTION

One object of the present invention is to provide a device for removing radioactive deposits from a fuel assembly in a nuclear plant, said device having such a construction that it results in a leakage of radioactive radiation as small as possible. The fuel assembly is to be reused after the treatment.

This object is obtained by means of the device initially defined, said device being characterized in that at least the second means are arranged in a γ-radiation-dampening medium.

Thereby, particularly γ-radiation from the radioactive material received by the second means is prevented from leaking out into the environment and making it difficult for or preventing personnel from being present in said environment.

According to a preferred embodiment of the inventive device, the second means comprises a filter, arranged to separate the radioactive material released from the fluid. Thereby, the device permits the radioactive material to be collected where it is surrounded by the γ-radiation-dampening medium, while, at the same time, the used fluid can be further transported and possibly once again fed by the first means into the container for a continued removal of the radioactive deposition.

According to another preferred embodiment of the inventive device, the γ-radiation dampening medium comprises water. Thereby, amongst others, the advantage of using an easily accessible and easy to handle medium is obtained. Amongst others, relatively unproblematic handling of the second means while they are located in the γ-radiation-dampening medium is thereby permitted.

According to another preferred embodiment of the inventive device, the container is arranged in the γ-radiation-dampening medium. Thereby, γ-radiation is effectively prevented from leaking out of the container to the environment. As the γ-radiation-dampening medium comprises a liquid such as water, it also has the advantage of accomplishing a cooling of the container surrounding the fuel assembly which most of the time is hot.

According to another preferred embodiment of the inventive device, the second means and the container are arranged in a basin which is filled with the γ-radiation-dampening medium. Thereby, the advantage of having the radioactive material removed from the fuel assembly and transported to the second means while being surrounded by the γ-radiation-dampening means is obtained, such that the radiation of the radioactive material to the environment is minimized during the transport thereof to the filter where it is separated from the fluid and collected. Moreover, for instance, such a solution is advantageous from a space point of view.

According to another preferred embodiment of the inventive device, the fluid comprises a mixture of a liquid and solid particles, preferably a mixture of water and ice. Thereby, the release of the radioactive material, the deposition, from the fluid assembly will preferably occur by means of abrasion, as the solid particles and the liquid move along the length of the fuel rods. Particularly, when the fluid comprises a mixture of water and ice, the ice will melt during the passage along the fuel rods and will finally leave the container in a liquid state. Thereby, these solid particles are prevented from later being caught by the filter for the reception of the radioactive material. The particles which at least initially are solid may of course also comprise any other suitable and meltable material than ice, for example a polymer, but ice has primarily the advantage of comprising water molecules, enabling it to form a homogenous mixture with the liquid as the latter is comprised by water.

According to another preferred embodiment of the inventive device, the fluid comprises a gas and/or steam, preferably water steam. Thereby, a turbulence of the fluid as it is fed through the container with the fuel rods therein is created, resulting in the solid particles getting a further distance along the fuel assembly before they melt, whereby a more evenly distributed abrasive effect is obtained along the length of the fuel assembly. In other words, a smaller amount of solid particles is required to obtain a result corresponding to the one obtained without gas. Prior art seeks to obtain similar effects by interchangeably feeding the fluid through the container from different directions. By combining the use of gas/steam with such a solution according to prior art, a further improved effect may be obtained.

According to another preferred embodiment of the inventive device, the gas comprises air.

According to another preferred embodiment, the device comprises means arranged to send infrasound towards the fuel assembly, The infrasound causes tensions in the radioactive deposition, facilitating the release of said deposition from the fuel assembly.

According to another embodiment, the device comprises a member arranged to rotate the fuel assembly. Thereby, a uniform flow over the cross-section of the fuel assembly is guaranteed, and regions with substantially different flow conditions are avoided. This in its turn results in an increased abrasive effect.

According to another preferred embodiment, the device comprises means arranged to heat at least a part of the fluid that is fed into the container. These means are preferably arranged to periodically intensively heat the fluid in order to obtain temperature changes in the fluid passing along the fuel assembly. The temperature changes of the fluid result in temperature chocks for the radioactive deposition, resulting in an increased degree of fracture formation in the deposition and a facilitated release of said deposition.

Further advantages and features of the present inventions will be disclosed in the following detailed description and in the rest of the dependent patent claims.

BRIEF DESCRIPTION OF THE DRAWINGS

The present invention will hereinafter be described more in detail, by way of example and without any delimiting purpose with reference to the annexed drawing in which.

DETAILED DESCRIPTION OF PREFERRED EMBODIMENTS

Figure 1:
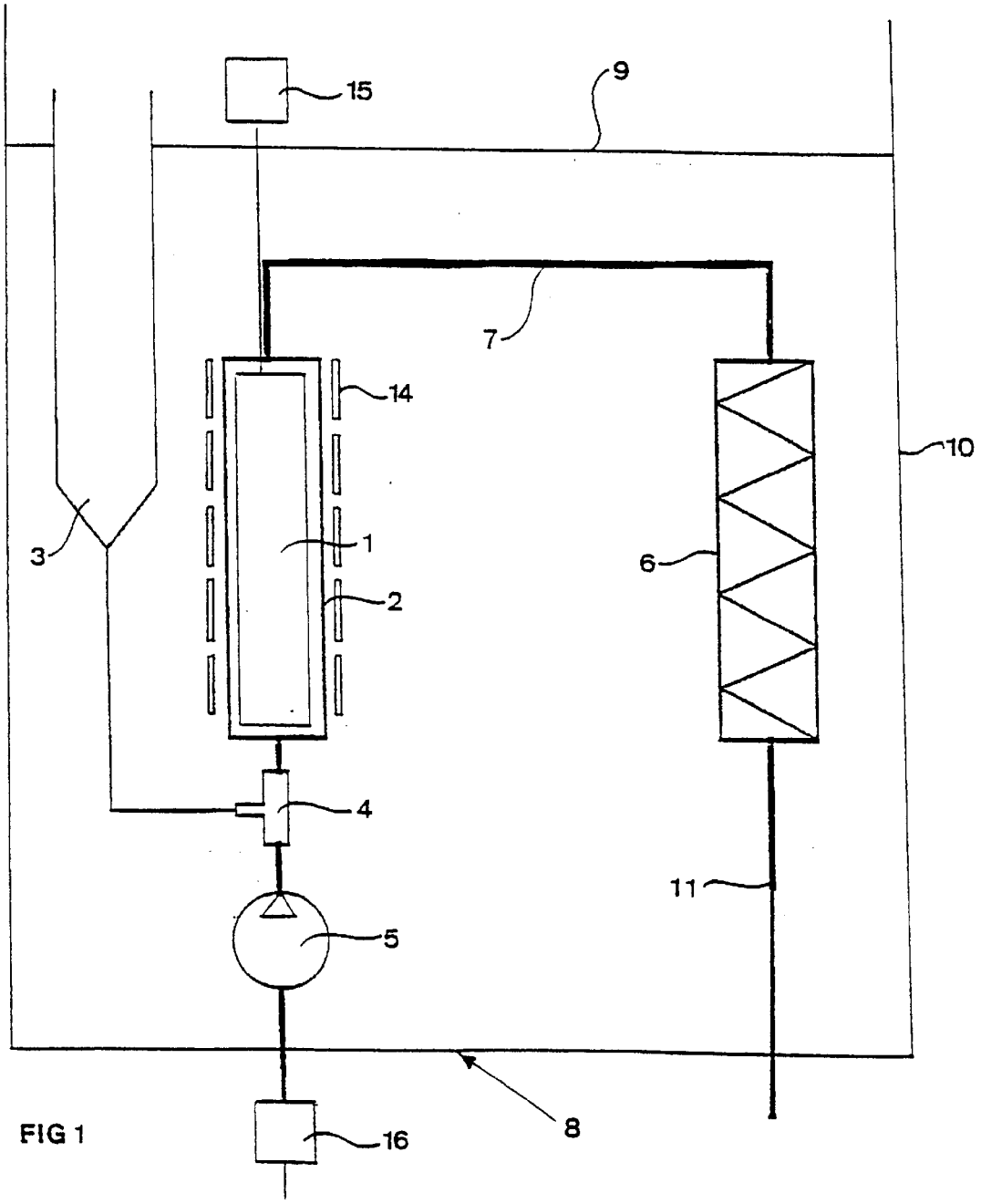
FIG. 1 shows a first embodiment of the device according to the invention, positioned in a basin.
Figure 2:
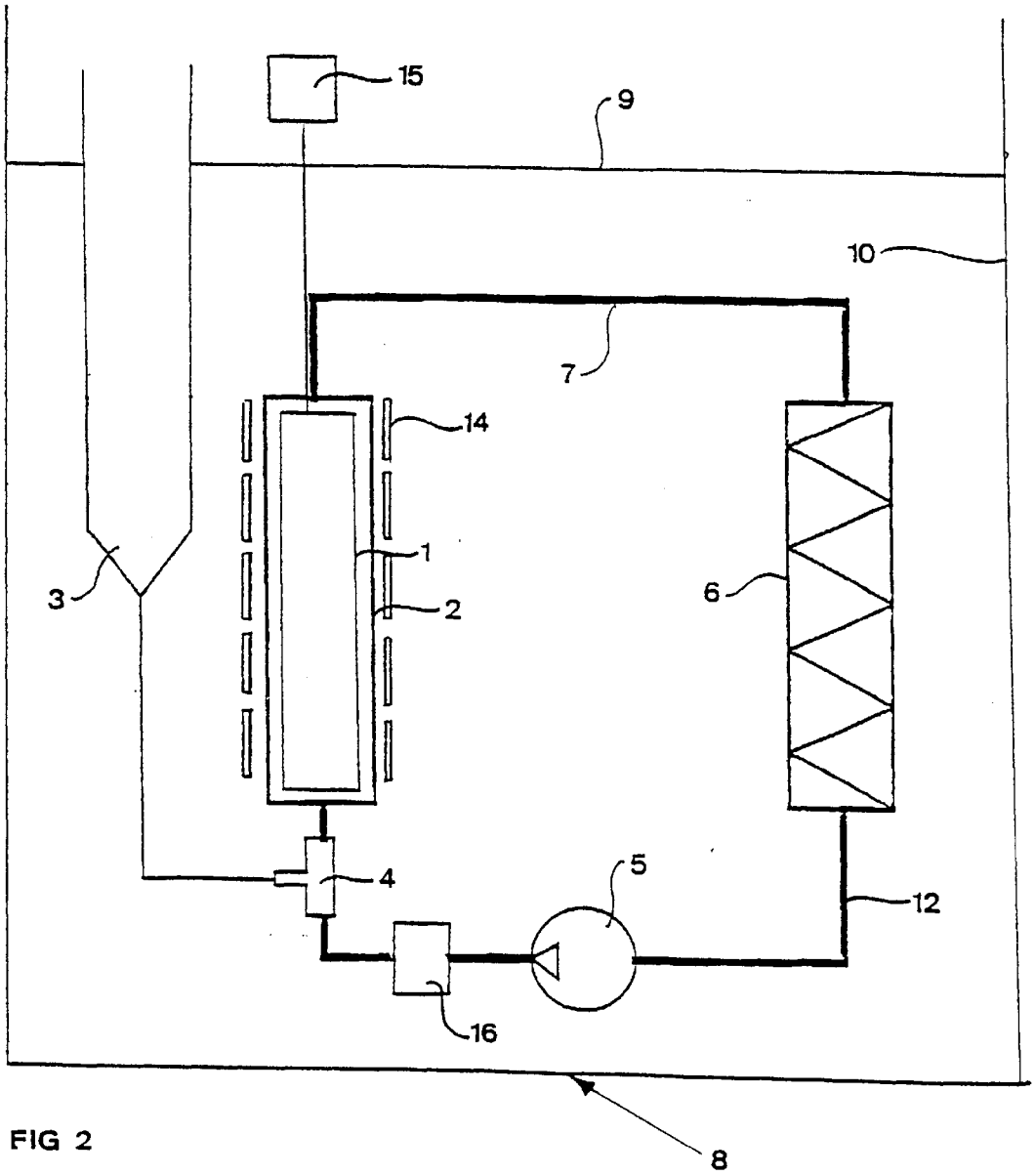
FIG. 2 shows a second embodiment of the device according to the invention, positioned in a basin.

Shown in FIGS. 1 and 2 are two embodiments of the inventive device, differing from each other by the fact that the device shown in FIG. 1 defines an open circuit for the transportation of a cleaning fluid, while the device shown in FIG. 2 defines a closed circuit for said transportation.

The device is arranged for the removal of a radioactive deposition from a fuel assembly 1 in a nuclear plant. For this purpose, the device comprises a container 2 accommodating the fuel assembly 1. Moreover, it comprises first means 3, 4, 5 which are arranged to feed a fluid into and through the container 2, the fluid being provided to release the deposition from the fuel assembly 1 by means of abrasion, and transport the radioactive deposition material thus released out of the container 2.

The device also comprises second means 6, 7 which are arranged to receive the radioactive material transported out of the container 2 by the fluid. These second means 6, 7 thereby comprise a filtering device 6 by which a filter is arranged to separate the released radioactive material from the fluid. Moreover, they comprise a tube conduit 7 extending from the container 2 to the filter 6 and arranged for the transportation of the fluid and the released, radioactive material.

The first means 3, 4, 5 comprise a feeding funnel 3 for solid particles, here ice particles, a first pump 4 in which the solid particles are mixed with a liquid, here water, and a second pump which pumps the liquid to the first pump 4. The first pump 4 is thereby arranged to suck into it the solid particles that are fed from the feeding funnel 3.

The device is arranged in a basin 8, which is filled with a γ-radiation-dampening medium, here water. In particular, the container 2 which accommodates the fuel assembly 1, and the second means 6, 7 are arranged at a considerable depth in order to avoid any larger amount of radiation, mainly gamma radiation (γ-radiation), from leaking out from the basin via the liquid surface 9.

According to FIG. 1, the second pump 5 providing the first pump 4 and the container 2 with liquid is connected to an external liquid source. Thereby, also the second means 6, 7 are connected, via a conduit 11, to an arrangement or the like (not shown) for the reception of the liquid fluid that has passed the filter 6 and thereby been separated from radioactive material. Accordingly, an open circuit exists.

However, in the embodiment according to FIG. 2, the second pump 5 is connected to the filter 6 via a conduit 12, the pump 5 being arranged to pump the liquid which has passed through the filter 6 back to the first pump 4 and the container 2. Accordingly, FIG. 2 describes a closed system. It should however be mentioned, that the closed circuit according to FIG. 2, at least after having been used for a certain time, requires some kind of liquid draining as the provision of solid particles which then melt and form a liquid phase results in a continuous increase of the amount of liquid in the circuit according to FIG. 2.

The first pump 4 is also arranged to suck into it a gas, in this case air, which then, together with the mixture of water and solid articles, is pumped into and through the container 2. Preferably, the first pump 4 is arranged to suck into it the gas and the solid particles. The fluid, thus comprising a liquid, here water, a gas, here air, and solid particles, here ice, is pumped into and through the container 2 which encloses the fuel assembly 1 which in its turn, in a way known per se, comprises a plurality of cladding tubes for nuclear fuel. Thanks to the effect of the gas (amongst others), giving rise to turbulence, a relatively rapid flushing through the container 2 can take place, with an abrasive action on the crud deposit which is present at the outside of the cladding tubes. Above all, loose crud is removed, and, for operational technical and economical reasons, this treatment should go on for a period as short as possible in order to make it possible to put the fuel assembly 1 into operation as soon as possible. Thereby, basin 8 is other than the basin in which the fuel assembly is arranged during operation. The time of treatment is approximately 15 minutes or less.

The device also comprises means 14 arranged to transmit infrasounds towards the fuel assembly 1. Those means 14 suitably comprise an infrasound source of a conventional sort and are only schematically shown in FIGS. 1 and 2. Moreover, the fuel assembly 1 is rotatably arranged in the container 2, and the device comprises a member 15, here a schematically shown motor, arranged to rotate the assembly 1. The rotational axis of the fuel assembly 1 thereby coincides with the longitudinal axis thereof.

The device also comprises means 16, schematically shown in FIG. 1 and 2, arranged to heat at least a part of the fluid which is fed into the container 2. The means 16 are preferably arranged to periodically heat the water which is delivered to the container 2. Suitably, when a flow of hot water into the container 2 is generated, no ice is fed into the fluid.

In order to obtain a treatment time which is as short as possible, a suitable mixture of liquid, solid particles and gas needs to be guided into the container 2. During the treatment of a boiling water reactor assembly, the flow of liquid should be approximately 10–50 kg/s, preferably 15–35 kg/s and most preferably 20–25 kg/s. For a pressure water reactor assembly, the corresponding amounts are 50–200 kg/s, 75–150 kg/s, and 100–125 kg/s. Approximately 1 kg air is added for each 20 liter of liquid, here water. The ice flow is approximately 30–70% of the liquid flow. The amount of ice added is preferably as low as possible within this interval, and, if possible, even lower. The size of the solid particles, that is the ice particles, is in the range of 5×5×5 mm.

Of course, a plurality of variants and embodiments will be obvious for the man skilled in the art without thereby leaving the very scope of the invention. The invention is also to be defined only by what is stated in the appended claims, the drawing and the rest of the description.

What is claimed is:

1. A method of removing a radioactive deposit from a nuclear fuel assembly in a nuclear plant, the method comprising: providing a container (2) arranged to accommodate the nuclear fuel assembly, and arranging said container (2) in a γ-radiation-dampening medium, wherein said γ-radiation-dampening medium comprises water, providing a first pumping means (3, 4, 5) for feeding by pumping a fluid through the container in order to release the deposit from the nuclear fuel assembly by abrasion and to transport radioactive deposit out of the container, said first means (3, 4, 5) also being provided for the feeding of a gas or steam or both to a fluid comprising a mixture of water and ice that is fed into and through the container in order to create a turbulence in the fluid; and further comprising feeding with said first means, a gas or steam or both to said fluid that is fed into and through the container (2) such that a turbulence is created in the fluid; providing a second receiving means (6, 7) arranged to receive the radioactive deposit transported out of the container (2) by the fluid, and wherein said second receiving means comprises a filter (6) arranged to separate released radioactive material from said fluid; arranging at least said second means (6, 7) in said γ-radiation-dampening medium, arranging a nuclear fuel assembly (1) in said container (2), feeding by pumping with said first pumping means (3, 4, 5) said fluid comprising a mixture of water and ice and said gas or steam or both through said container (2), thereby releasing, by abrasion, a radioactive deposit from said nuclear fuel assembly (1) and transporting the radioactive deposit out of the container (2), receiving the transported radioactive deposit in said second means (6,7), and further comprising filtering with said filter to separate from said fluid the radioactive material that is released.

2. The method, according to claim 1, which comprises feeding a gas to said fluid that is fed into and through the container such that a turbulence is created in the fluid.

3. The method, according to claim 1, which comprises feeding air to said fluid that is fed into and through the container such that a turbulence is created in the fluid.

4. The method according, to claim 1, which comprises feeding steam to said fluid that is fed into and through the container such that a turbulence is created in the fluid.

5. The method of claim 4 wherein said steam comprises water steam.

6. The method according to claim 1, which further comprises arranging said container (2) and said receiving means in a basin filled with said γ-radiation-dampening medium.

7. The method according to claim 1, further comprising irradiating said fuel assembly with infrasound.

8. The method according to claim 1, further comprising rotating said fuel assembly.

9. The method according to claim 1, further comprising heating at least a portion of said fluid that is fed into said container.

10. The method according to claim 1 wherein said deposit comprises loose crud.

11. The method according to claim 1 wherein the nuclear fuel assembly is a boiling water nuclear fuel assembly and the flow rate of said fluid is about 10–50 kg/s.

12. The method according to claim 11 wherein the ice flow is about 30–70% of the water flow.

13. The method according to claim 11 wherein said flow rate is 15–35 kg/s.

14. The method according to claim 11 wherein said flow rate is 20–25 kg/s.

15. The method according to claim 1 wherein the nuclear fuel assembly is a pressure water nuclear fuel assembly and the flow rate of said fluid 50–200 kg/s.

16. The method according to claim 15 wherein the flow rate of said ice is about 30–70% of the flow rate of said fluid.

17. The method according to claim 15 wherein said flow rate is 75–150 kg/s.

18. The method according to claim 15 wherein said flow rate is 100–125 kg/s.

19. The method of claim 1 which comprises recycling fluid after the filtering back to said first pumping means.

* * * * *